US006715610B2

(12) United States Patent
Wait et al.

(10) Patent No.: US 6,715,610 B2
(45) Date of Patent: Apr. 6, 2004

(54) SLURRY TREATMENT

(75) Inventors: Simon Timothy Wait, Scotland (GB); Michael Richard Brannan, Scotland (GB)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/917,529

(22) Filed: Jul. 27, 2001

(65) Prior Publication Data

US 2002/0066695 A1 Jun. 6, 2002

(30) Foreign Application Priority Data

Jan. 28, 1999 (GB) ..... 9901838
Jan. 28, 2000 (WO) ..... PCT/GB00/00253

(51) Int. Cl.[7] ..... B07B 1/00
(52) U.S. Cl. ..... 209/10; 406/93
(58) Field of Search ..... 209/4, 10; 406/93, 406/94, 95, 197

(56) References Cited

U.S. PATENT DOCUMENTS

| | | | | | |
|---|---|---|---|---|---|
| 3,316,024 | A | * | 4/1967 | Nakano | 406/93 X |
| 3,637,263 | A | * | 1/1972 | Wasp | 406/197 X |
| 3,762,773 | A | * | 10/1973 | Schroeder | 406/197 X |
| 3,881,775 | A | * | 5/1975 | McPherson et al. | 406/197 X |
| 4,149,603 | A | | 4/1979 | Arnold | |
| 4,242,146 | A | | 12/1980 | Kelly, Jr. | |
| 4,313,785 | A | | 2/1982 | Schellstede | |
| 4,439,069 | A | | 3/1984 | Kelly, Jr. et al. | |
| 4,480,702 | A | | 11/1984 | Kelly, Jr. | |
| 4,871,284 | A | * | 10/1989 | Duffy | 406/197 X |
| 5,085,277 | A | | 2/1992 | Hopper | |
| 5,361,998 | A | | 11/1994 | Sirevag et al. | |
| 6,585,115 | B1 | * | 7/2003 | Reddoch et al. | 209/3 |
| 2003/0202847 | | * | 10/2003 | Snowdon | 406/122 |

FOREIGN PATENT DOCUMENTS

| | | | | |
|---|---|---|---|---|
| GB | 2318370 A | | 4/1998 | |
| SU | 713796 | * | 2/1980 | 406/93 |
| WO | WO 93 13291 A | | 7/1993 | |
| WO | WO 93 20328 A | | 10/1993 | |
| WO | WO 99 15758 A | | 4/1999 | |

OTHER PUBLICATIONS

"Norwegian Injection Method Uses Separate Line to Wellhead", Offshore, US, Petroleum Publishing Co., Tulsa, vol. 58, No. 4, Apr. 1, 1998, p. 84.

* cited by examiner

*Primary Examiner*—Donald P. Walsh
*Assistant Examiner*—Joseph Rodriguez
(74) *Attorney, Agent, or Firm*—Craig W. Roddy; Karen B. Tripp

(57) ABSTRACT

Drill cuttings slurries and the like are transported by high pressure pumping the slurry through an extended pipeline, if necessary after treatment of the slurry to render it suitable for high pressure pumping. Apparatus for pumping the slurry includes a tank for receiving the slurry to be pumped, means for agitating the slurry in the tank to mix it, and a high pressure pump for receiving slurry from the tank for pumping away from the tank.

23 Claims, 1 Drawing Sheet

SLURRY TREATMENT

Figure 1:
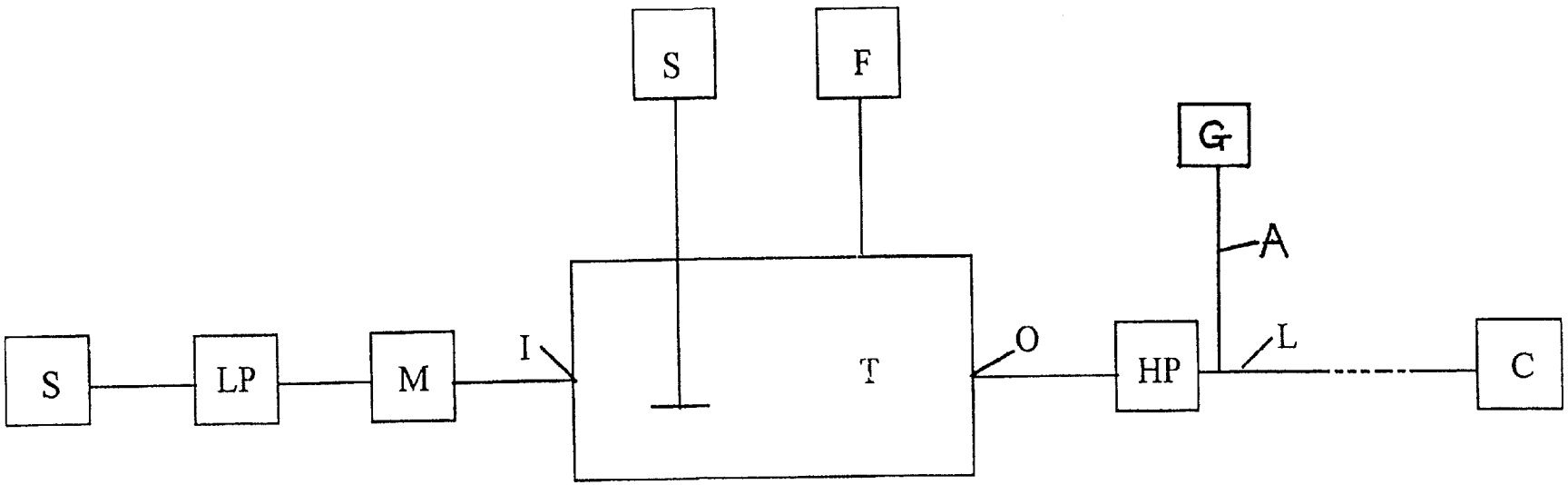

This application claims priority to International Patent Application No. PCT/GB00/00253, filed Jan. 28, 2000, claiming priority to Great Britain Patent Application No. 9901838.4, filed Jan. 28, 1999.

This invention relates to slurry treatment, and particularly but not exclusively to the treatment of drill cuttings.

In the drilling of a well, drilling mud is pumped down the drill string to the drill bit, and the mud returns up the annular space between the drill string and the wall of the well, carrying with it the drill cuttings. In normal drilling, the solid cuttings comprise earth, rock and other materials of the strata through which the well is being drilled. In other instances, the drilling may be made into cement or even abandoned downhole tools and the drill cuttings may then include cement and/or metal pieces. The spent drilling mud carrying with it the drill cuttings is treated to separate out the drill cuttings before the drilling mud can be refused.

The separated drill cuttings, in suspension in drilling mud, are then transported away from the well to a plant for their thermal desorption or other disposal treatment. The transport of a drill cuttings slurry requires significant and expensive precautions to be taken to avoid spillage and, thus, environmental pollution. On land, drill cuttings slurries are transported by truck. For offshore drilling, the slurries are returned to land by skip, barge or other container and then transported by truck.

Offshore drilling is, for example, disclosed in "Norwegian injection method uses separate use to wellhead", Offshore, April 1998, p84. This document discloses a method for dealing with drill cuttings from sub-sea formations. A drill cuttings slurry is formed on the off-shore rig, then pumped under pressure via a flexible riser back to the sub-sea wellhead for injection into the formation. This method avoids having to transport the cuttings to shore.

WO 93/20328 discloses a method and apparatus for processing drill cuttings, which method includes the formation of a solid-rich drill cuttings slurry which is then injected into a subsurface formation. The object of the cuttings processing system described in WO 93/20328 is to provide a satisfactory slurry for injection into the formation.

It will be appreciated that transfer of the slurries from a barge, for example, for a few feet (a few 0.3 m) to a truck can present risks of spillage but this risk has been much reduced by pumping the slurry from the barge into the truck on land. For this purpose, low pressure high flow pumps are used which can accommodate the solids content of drill cuttings slurries and move them the short distances involved. However, the subsequent transport by truck over longer distances is environmentally risky, as is the emptying or discharge of the slurry from the truck at its destination.

We have now found that surprisingly, drill cuttings slurries can be moved over extended distances by pumping, and this eliminates the need for the use of trucks and all the attendant spillage risks.

According to one aspect of the present invention, therefore, there is provided a method of transporting drill cuttings and the like for treatment or disposal away from the source of the slurry, which comprises pumping them with a high pressure pump through an extended pipeline.

According to a feature of the present invention, a high pressure pump is used to pump the drill cuttings through an extended pipeline. As is known, high pressure pumps can also be operated at lower pressures, and in accordance with the invention, the high pressure pump may be so operated to transport the drill cuttings. The important point is that it is a high pressure pump and is thus able to deliver high pressure pumping when needed or lower pressure pumping as appropriate. In this way, optimum pumping is available at all times during operation.

In general, for safety reasons, we prefer if possible to pump the drill cuttings through the extended pipeline at a low, rather than a high, pressure. In order to achieve low pressure transport, the slurry must be of an appropriate low viscosity: higher viscosity slurries require higher pressure pumping. The viscosity of a slurry can be reduced, if necessary, by adding fluids thereto, e.g. oil or drilling mud or other fluids.

A further possibility to assist low pressure flow is to pump a fluid into the extended pipeline at or downstream of the high pressure pump, and preferably immediately downstream thereof. The fluid is preferably introduced in the same general direction as the slurry flow in order to assist the flow of the slurry. The introduction of the fluid in effect lowers the viscosity of the slurry. We prefer to use air as the fluid, the air being injected from an air hose connected to a compressor. This will, of course, only be feasible if the air (or other fluid) supply is at a greater pressure than that prevailing at the injection point in the extended pipeline. In general, air pressures of up to about 100 psi (about 7 bar) can be used.

As will be well understood by those skilled in the art, the constitution of a drill cuttings slurry can vary widely. However, to be safely pumpable using a high pressure pump, it must be free of large solid lumps (e.g. greater than 5 mm in size). To this end, we prefer to pass the slurry through a suitable screen and/or one or more macerators to remove or crush any large solids, before the slurry passes to the high pressure pump.

Also, before being passed to the pump, the drill cuttings slurry is preferably homogenised to ensure optimum pumping. This can be achieved, for example, by stirring or otherwise mixing the slurry.

When high pressure pumping is used in the present invention, it would normally be at a pressure of at least 10 bar, whereas with the low pressure pumping would normally be below about 5 bar. High pressure pumps suitable for use in the present invention are commercially available, examples being Halliburton ST 400. We have found that, in accordance with the present invention, drill cuttings can be pumped considerable distances, for example from 50 m up to about 200 m or more. This is normally quite sufficient to transport the cuttings to a storage or treatment station, but if necessary one or more auxiliary pumps can be provided in the pipeline so as to extend the distance pumped.

We prefer that the drill cuttings slurry contain from 30 to 70% solids by volume, more preferably from 40 to 60%.

According to a further aspect of the invention, there is provided apparatus for pumping a drill cuttings slurry or the like, which apparatus comprises a tank for receiving the slurry to be pumped, preferably means for removing large solids from the slurry, preferably means for adding fluid to the slurry, means for agitating the slurry in the tank to mix it, and a high pressure pump for receiving slurry from the tank for pumping away from the tank.

Preferably, the means for removing large solids from the slurry is upstream of the tank so that raw slurry passes therethrough before reaching the tank. Suitable means include screens and/or macerators. Any large solids can be separated or crushed to smaller size, as appropriate. Most preferably, the screens or macerators are located on, e.g. on the suction side of, or otherwise incorporated with, a conventional low pressure pump which may, for example, be located on a barge carrying slurry from an offshore well. In this case, the screened and/or macerated slurry is then pumped under low pressure from the barge to the tank. Alternatively, the screens or macerators may be mounted above the tank so that treated slurry exiting the screens or macerators is delivered under gravity into the tank, although this is not preferred.

The fluid adding means preferably comprises one or more containers for oil, drilling mud or other fluid, for addition to the slurry as required to achieve a pumpable consistency. Advantageously, the container(s) can be mounted above the tank.

Agitation of the slurry contents of the tank is important to ensure a satisfactory feed to the high pressure pump. Without agitation, there can be settlement of solids in the tank which is undesirable. Agitation can be effected by, for example, mounting one or more stirrers in the tank, or in any other suitable manner.

The high pressure pump receives slurry from the tank and pumps it away, preferably at the lowest pressure at which the desired slurry transport can be efficiently effected. Preferably, the outlet from the tank to the pump is mounted at of near the base of the tank.

According to a feature of the invention, it is preferred that the apparatus be in modular form so that it can be transported to, and constructed on, site relatively easily. The modules may, for example, comprise the tank, the pump, the fluid storage container(s) and the macerators or screens.

Whilst the apparatus and method of the invention have been particularly described with reference to drill cuttings, they are also of utility with other similar slurries such as mine waste slurries.

In order that the invention may be more fully understood, reference is made to the accompanying drawing which is a schematic drawing illustrating the method and apparatus of the invention.

Referring to the drawing, there is shown a tank T for receiving drill cuttings slurry or the like. The tank is equipped with a stirrer S of a suitable type, to maintain slurry in the tank well stirred. Tank T has an inlet I through which it receives slurry. The slurry comes from source S which may be, for example, a barge or the like carrying the slurry from an offshore well. The raw slurry is removed from the source S suitably using a low pressure pump LP which can cope with any large solids in the slurry. If desired, fluid can be added to the raw slurry at this stage to improve pumpability.

In prior art procedures, raw slurry from source S is pumped by pump LP and delivered to a truck or the like for transport to its eventual destination C. However, according to a feature of the present invention, the need for such ground transport is obviated. Instead, the slurry is passed to macerators or screens M in order to remove or crush large solids, and the treated slurry then passes through inlet I to tank T.

The treated slurry in tank T is agitated by stirrer S and, if necessary, further fluid can be added from fluid storage container F. The slurry is then withdrawn through tank outlet O to high pressure pump HP from which it is pumped through pipeline L to corral C. The length of pipeline L can be several hundred meters or more, with further high pressure pumps being provided in line L as necessary.

At or downstream of the exit side of pump HP a pressure fluid supply line A can be provided to pump fluid such as air from source G into line L to assist the slurry flow and to lower its viscosity.

It will be appreciated that the design of apparatus can be varied. For example, the use of macerators or screens M may be unnecessary when the raw slurry from S is of sufficiently small solids size not to damage the high pressure pump HP. Also, the provision of fluid source F may be unnecessary or it may be re-sited to deliver fluid upstream of low pressure pump LP, for example. Also, macerators M can be upstream of pump LP.

A more particular description of one example of the method and apparatus of the invention is as follows.

Drilled cuttings are transported by barge to a jetty. Transfer to the quayside tank T may be effected using, for example, a low pressure Dragflow HY85 150HP Pumpset or Monopumps model SE101MS1J8/H95Y, fitted with two EXYH20 Excavators, supplied by Pumps and Process Systems. The pump and agitators are suspended in the cuttings slurry using a Samsung SE 210W excavator.

During transit in the barge, the cuttings slurry may settle out to some extent, with a liquid phase on top and compacted solids below. Prior to pumping, the contents of the barge compartment will be homogenised using the excavators.

Prior to any transfer, the properties of the slurry are preferably ascertained, particularly the viscosity.

Tank T acts as a staging point whereby the whole transfer process is controlled.

The apparatus is modular and comprises four separate parts:

Macerators (e.g. Munchers (trade mark))

Holding and Homogenising Tank (T)

Base Oil Tank (F)

Mono Pump Module (HP)

The modular design of the tank gives a great deal of flexibility.

On completion of pumping operations, each section may be removed separately for cleaning and storage.

Should a problem develop with any section, it can be serviced separately. Replacement equipment may be installed if required.

The tank unit has a potential secondary use in the transfer of the cuttings slurry from the holding corral (C) to the feed hopper on a thermal desorption plant.

The slurry feed from the barges S enters the macerator which is preferably integrated with low pressure pump LP. Preferably, a pumping device such as that disclosed in GB 9908056.6 is employed. This can comprise a low pressure pump integrated with a macerating chamber. Preferably, two macerators are used. These may be Mono Munchers, type SA210ACW5B1/504. The macerators each comprise stainless steel housing containing two sets of counter rotating intermeshing cutters revolving at a fixed speed of 83 RPM. These grade the cuttings to 5 mm or less at a process rate of 50 $m^3$ per hour each.

Tank T is situated on the quayside and is, for example, 5.7 m long, 2.4 m wide and up to 2 m deep. The bottom of the tank is sloped to feed the slurry towards the outlet O.

The only inlet I to this tank is through the macerators. Without exception, all slurry is processed and graded to protect the Mono pump HP situated downstream.

The outlet O is in the base of the tank and feeds directly into the main pump package HP, the Mono Pump, type SE106MS1R8/E91S.

Agitators are provided in tank T to agitate the slurry.

The agitators rotate at low speed to limit the breakdown of cuttings in the slurry. The blades are 1.7 m in diameter, the one towards the front of the tank rotating with a lifting motion, the rear with a downward motion enhancing the feed to the Mono pump.

Two 4.5 $m^3$ capacity horizontal cylindrical storage tanks (F) are located on top of the tank T and contain base oil or drilling mud for the dilution of the cuttings slurry should the viscosity become too high. The contents of the tanks F may be discharged through a grating on the top of the tank, to be mixed into the slurry using the agitators.

Should it be necessary, the tanks may also be used on the barge to dilute the compartment contents prior to transfer to the tank T. The fluid would be mixed into the slurry using the hydraulic agitators on the Dragflow or Monopumps pump.

The high pressure pump HP is preferably situated at the base of the tank T. The pump is preferably a flexishaft driven progressive cavity type with stainless steel wetted parts. It transfers the macerated cuttings from the homogenising tank to the holding corral at 50 $m^3$/hour and 36 bar head. The drive shaft is sealed with a conventional packed gland and access ports are provided in the suction chamber for cleaning and the introduction of base oil from the storage tank if necessary.

The cuttings are pumped along either of two 170 meter long, pipelines L to the holding corrals C. Compressed air at 100 psi (0.69 MPa) can be introduced into line L in the same general direction as the slurry flow.

The pipelines are constructed from seamless welded Schedule 80 API 5L Grade B that, at 35 bar operating pressure, gives 7.2 mm allowance for corrosion and erosion.

What is claimed is:

1. A method of transporting drill cuttings slurries for treatment or disposal away from the wellbore, wherein said slurry consists essentially of drilling fluid and drill cuttings, and which method comprises pumping the slurry through an extended pipeline using a high pressure pump at a pressure of at least 10 bar, characterised in that compressed air is pumped into the extended pipeline at the exit of the high pressure pump or downstream thereof to assist slurry flow, wherein said air is pumped at a greater pressure than the pressure in said pipeline upstream said pump.

2. A method according to claim 1, wherein before said pumping, the slurry is passed through a screen to remove any large solids in the slurry.

3. A method according to claim 2, wherein the screened slurry is substantially free of solid lumps greater than about 5 mm in size.

4. A method according to claim 1, wherein before said pumping, further fluid is added to the slurry to adjust its viscosity.

5. A method according to claim 1, wherein before said pumping, the slurry is homogenised by mixing or stirring.

6. A method according to claim 1, wherein the slurry is pumped at a pressure of below 5 bar.

7. A method according to claim 1, wherein the slurry is pumped through an extended pipeline over a distance of 150 m or more.

8. A method according to claim 1, wherein the slurry contains from 30 to 70% solids by volume.

9. A method according to claim 1, wherein the said pumping is performed either by using a single high pressure pump or by using two or more such pumps at intervals along the length of the pipeline.

10. A method according to claim 1, wherein before said pumping, the slurry is passed through one or more macerators to crush any large solids in the slurry.

11. A method according to claim 10, wherein the macerated slurry is substantially free of solid lumps greater than about 5 mm in size.

12. Apparatus for pumping a drill cuttings slurry which apparatus comprises a tank for receiving the slurry to be pumped, means for agitating the slurry in the tank to mix it, a high pressure pump for receiving slurry from the tank for pumping away from the tank, and means for pumping compressed air into the exit of the high pressure pump or downstream thereof to assist slurry flow.

13. Apparatus according to claim 12, wherein the means for agitating the slurry in the tank comprises one or more stirrers mounted in the tank.

14. Apparatus according to claim 12, further comprising means for removing large solids form the slurry and means for adding fluid to the slurry.

15. Apparatus according to claim 14, wherein the means for removing large solids from the slurry is a screen or one or more macerators.

16. Apparatus according to claim 14, wherein the means for adding compressed air to the slurry comprises one or more compressed air storage containers mounted above the tank.

17. Apparatus according to claim 12, wherein the apparatus is in modular form.

18. Apparatus according to claim 17, wherein the modules comprise a tank, a high pressure pump, one or more fluid storage containers and one or more macerators or screens.

19. A method of removing drill solids away from a wellbore surface for disposal or treatment of said drill solids, said method comprising:

(a) providing a slurry of said drill solids, said slurry consisting essentially of drilling fluid and 30% to 70% drill solids;

(b) ensuring that the slurry is substantially free of solid lumps of drill solids greater than about 5 mm in size;

(c) homogenising said slurry by low speed agitation;

(d) pumping said agitated slurry through a high pressure pump into a transport pipeline at a pressure of at least 10 bar;

(e) injecting compressed air into said pipeline behind the exit of said high pressure pump at a pressure greater than the pressure at the entrance to said pressure pump so that said compressed air enhances transport of said slurry in said pipeline.

20. The method of claim 19 wherein said slurry is ensured to be substantially free of solid lumps of drill solids greater than about 5 mm in size by passing said slurry through a screen.

21. The method of claim 19 wherein said slurry is ensured to be substantially free of solid lumps of drill solids greater than about 5 mm in size by passing said slurry through one or more macerators which crushes drill solids greater than about 5 mm in size to a size less than about 5 mm in size.

22. The method of claim 19 wherein drilling fluid is added to said drill solids so that said slurry consists essentially of 30% to 70% drill solids.

23. The method of claim 19 wherein said slurry is provided in a tank on a barge near said wellbore surface which is located offshore and said transport pipeline is on a jetty.

* * * * *